US007357007B2

(12) United States Patent
Lin

(10) Patent No.: US 7,357,007 B2
(45) Date of Patent: Apr. 15, 2008

(54) COMBINATION AND KEY OPERATED PADLOCK WITH DEVICE FOR INDICATING THE LOCK HAS BEEN OPENED BY A KEY

(75) Inventor: Chu Pao-Feng Lin, Wugu Township, Taipei County (TW)

(73) Assignee: Koyaku Industry Co., Ltd., Taipei County (TW)

( * ) Notice: Subject to any disclaimer, the term of this patent is extended or adjusted under 35 U.S.C. 154(b) by 0 days.

(21) Appl. No.: 11/487,326

(22) Filed: Jul. 14, 2006

(65) Prior Publication Data

US 2008/0011025 A1 Jan. 17, 2008

(51) Int. Cl.
*E05B 37/02* (2006.01)

(52) U.S. Cl. ..... 70/21; 70/25; 70/284; 70/285; 70/432; 70/DIG. 63; 70/DIG. 71

(58) Field of Classification Search ..... 70/21, 70/22, 25, 26, 38 R, 38 A, 38 B, 432–441, 70/DIG. 63, DIG. 71, 284, 285
See application file for complete search history.

(56) References Cited

U.S. PATENT DOCUMENTS 6,848,283 B1 * 2/2005 Lin ..... 70/21
6,877,345 B1 * 4/2005 Misner et al. ..... 70/25
7,100,401 B2 * 9/2006 Yu ..... 70/21
7,155,944 B1 * 1/2007 Lin ..... 70/21
2005/0262902 A1 * 12/2005 Ling et al. ..... 70/21
2006/0107708 A1 * 5/2006 Yu ..... 70/21
2006/0107709 A1 * 5/2006 Yu ..... 70/21
2006/0236731 A1 * 10/2006 Yu ..... 70/21
2006/0254325 A1 * 11/2006 Yu ..... 70/21

* cited by examiner

*Primary Examiner*—Lloyd A. Gall
(74) *Attorney, Agent, or Firm*—Pro-Techtor Int'l Services

(57) ABSTRACT

A combination and padlock includes a housing including a front window, a dial assembly, a cylinder having a keyhole, a rotatable member secured to cylinder and having a spiral groove, a sleeve including fingers moveably retained in the groove, an indicator slidably mounted on the sleeve and including a first state surface having a color aligned with the window in a locked position, and a second state surface having a different color, and a shackle. Inserting a key into the keyhole to clockwise turn the cylinder and the rotatable member will move the sleeve downward by moving the fingers along the groove in one direction, and unlock the lock with the second state surface moved to align with the window for visually informing that the lock has been opened by the key. Alternatively, counterclockwise turning the inserted key will lock the lock and reset the indicator.

1 Claim, 6 Drawing Sheets

COMBINATION AND KEY OPERATED PADLOCK WITH DEVICE FOR INDICATING THE LOCK HAS BEEN OPENED BY A KEY

BACKGROUND OF THE INVENTION

1. Field of Invention

The present invention relates to combination and key operated padlocks and more particularly to such a combination and key operated padlock having a window on its housing and a slidable indicator in the window so as to advise the owner of the lock by a different color that the lock has been opened by a key for, example, inspection.

2. Related Art

Combination and key operated padlocks (i.e., padlocks that can be operated by combination or by key) are not new. For example, U.S. Pat. No. 6,848,283 B1 discloses a combination lock capable of being opened by a key or inhibited the same. The features of the "283" patent are below. A cylinder 40 is adapted to prevent a shackle 20 from turning relative to a body 10 when the lock is in a locked position. In the locked position, inserting a key 91 into a keyhole to turn a staged abutment member 80 will open the lock by unlocking the shackle 20 by engaging a ratchet 82 of the abutment member 80 with a ratchet 45 of the cylinder 40 to move the spring-biased cylinder 40 toward inside of the body 10.

The "283" patent has the advantage of opening a lock by a simple mechanism. However, the spring 70 associated with the cylinder 40 is always compressed. Thus, the spring 70 may suffer fatigue after a predetermined times of use. Further, the owner of the lock cannot visually observer that the lock has been opened by a key from the surface of body 10 after the cylinder 40 has returned to its original position.

Still, U.S. Pat. No. 6,877,345 B1 discloses a combination and key operated padlock with indicator. The "345" patent enables the owner of the lock to visually understand whether the lock has been opened by a key 175 or not by displaying a color "red" or "green" of a resettable indicator through a window on its housing. However, its mechanisms are typically relatively complex in constructions, costly to manufacture, and unreliable in use. Thus, the need for improvement still exists.

SUMMARY OF THE INVENTION

It is therefore an object of the present invention to provide a combination and key operated padlock having a window on its housing with a slidable indicator in the window having a different color, so as to advise the owner of the lock that the lock has been opened by a key.

In one embodiment, the present invention has a housing formed of a front shell and a rear shell including a window formed through the front shell, a plurality of right slots, a left compartment having bottom and top openings, and a fixed stop groove adjacent the compartment; a dial assembly including a plurality of wheel-like dials projecting out of the slots and each having a plurality of indicia formed on its outer surface, and a plurality of first teeth formed on its inner surface, and a plurality of tumbler sleeves each having a plurality of second teeth on its outer surface adapted to lockingly engage with the first teeth; a leaf spring having a plurality of arms pressed against the peripheries of the dials to assist in retaining the dials in their current positions; a cylinder mounted in a lower portion of the compartment and including a bottom keyhole proximate and aligned with the bottom opening of the compartment, and a protuberance; a cylindrical rotatable member including a bottom hole conformed to securely receive the protuberance, and an upper spiral groove; a sleeve member mounted in an upper portion of the compartment and including a pair of opposing bottom projecting fins moveably retained in the groove and stopped with the stop groove respectively, a flat cut in a middle portion, an axial channel, a lower elongated trough for dividing the cut into two spaced portions, a plurality of furrows on a lower portion of the trough, and a hollow upper protrusion in communication with the channel and projected out of the top opening of the compartment, the sleeve having an internal shoulder and a plurality of furrows on an inner surface; an indicator mounted on the cut and including a lengthwise rod fitted in the channel and engaged with the protuberance and having a top member aligned with and adapted to urge against a bottom of the protrusion, an indication surface adapted to move between two end walls of the cut and including a first state surface having a first color aligned with the window in a locked position of the lock and a second state surface having a second color different from the first color, a limiting member engaged with the trough, and a resilient latch adapted to secure to one of the furrows for assisting a positioning of the indicator; and a substantially U-shaped shackle including a long leg in the slots and having a plurality of projecting locking fins slidably retained in the dial assembly, and a short leg having a bottom end engaged with the upper protrusion in the locked position of the lock, the shackle adapted to rotate about an axis of the long leg relative to the housing.

Inserting a key into the keyhole to turn the cylinder together with the rotatable member will move the sleeve member downward by moving the fin along the groove in one direction, move the upper protrusion of the sleeve member downward relative to the short leg disengaging the shackle, and unlocking the lock with the indication surface moved from a lower portion of the cut to its upper portion for aligning the second state surface with the window for visually informing that the lock has been opened by the key. Setting a correct combination of the dial assembly, and pulling upward will allow the shackle to disengage from the upper projection, opening the lock without changing the indication surface aligned with the window; with the shackle open, a slender object may be pressed downward into the top opening of the protrusion for resetting the indicator.

The above and other objects, features and advantages of the present invention will become apparent from the following detailed description taken with the accompanying drawings.

DETAILED DESCRIPTION OF THE INVENTION

Figure 1:
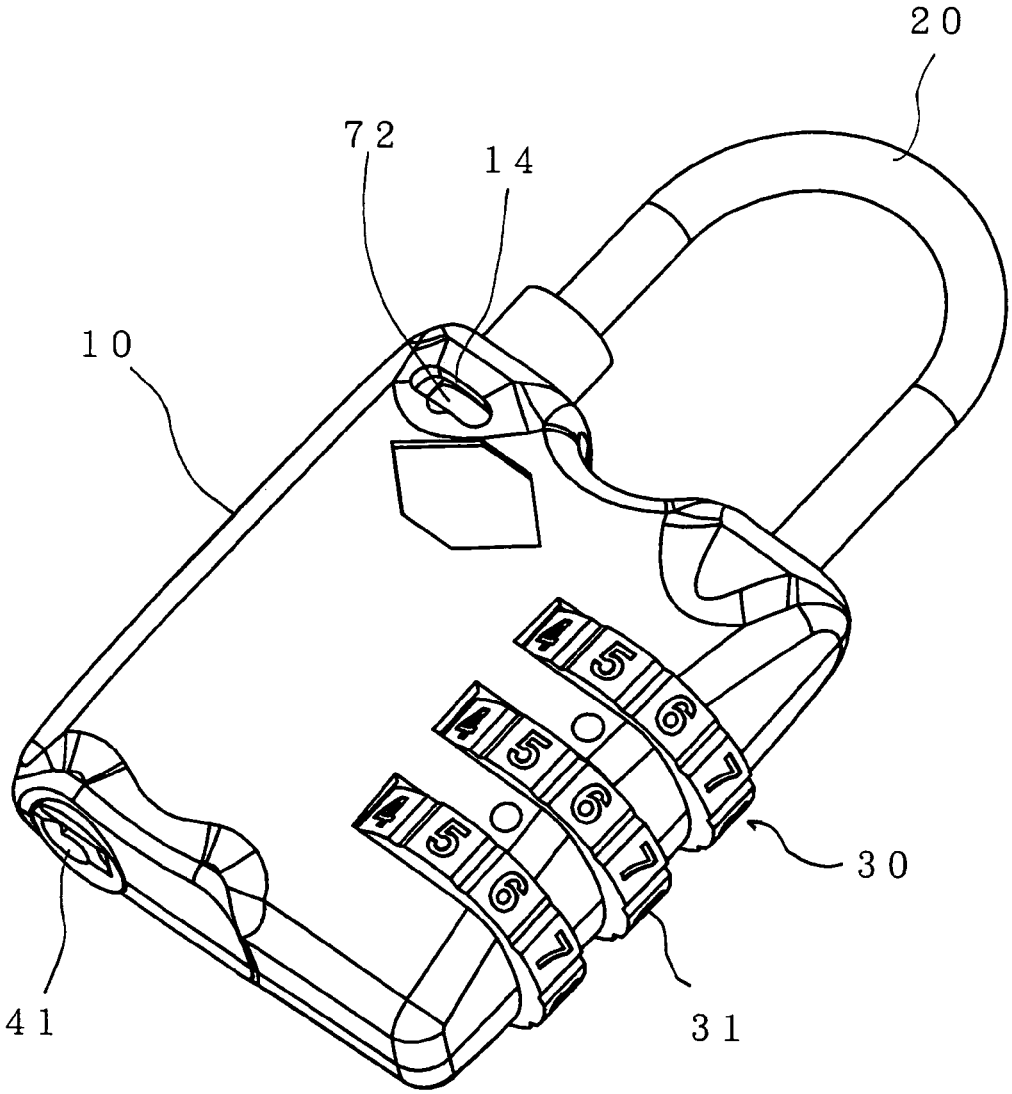
FIG. 1 is a perspective view of a preferred embodiment of combination and key operated padlock according to the invention.
Figure 2:
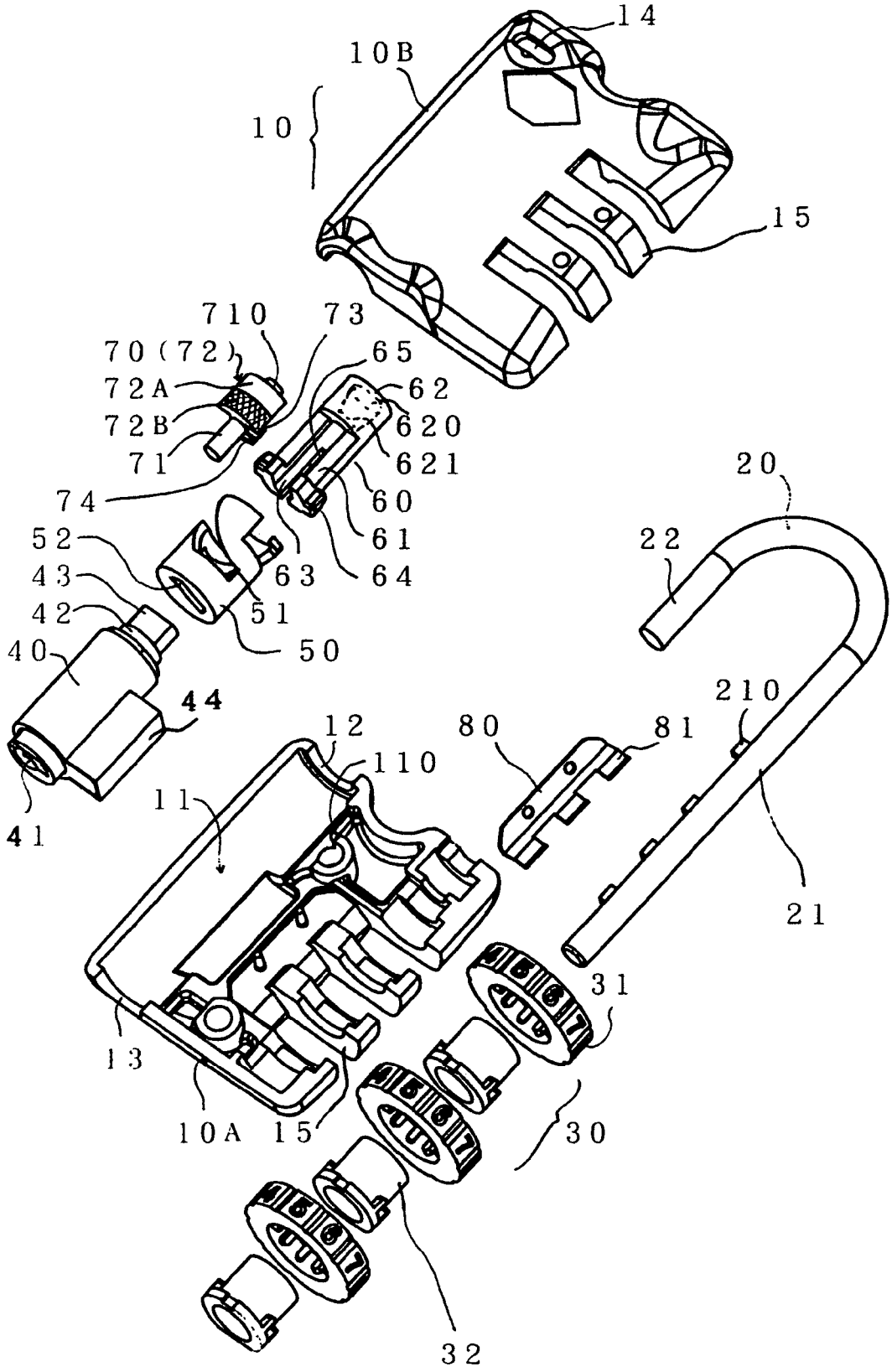
FIG. 2 is an exploded view of the lock.
Figure 3:
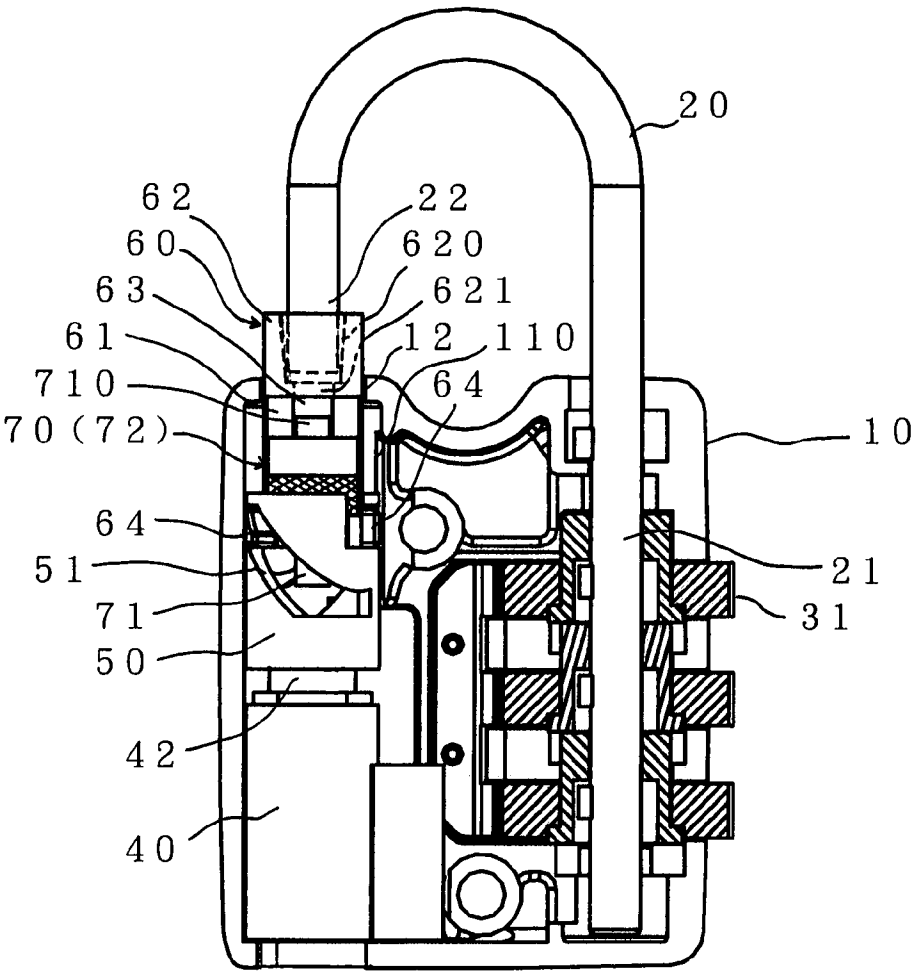
FIG. 3 is a front view of the lock of FIG. 1 in part section with the front shell of the housing removed and the shackle locked.

Referring to FIGS. 1 to 9, a combination and key operated padlock (i.e., lock) in accordance with a preferred embodiment of the invention comprises a rectangular housing 10 including a front shell 10B having a window 14 formed therethrough; and a rear shell 10A including a half-cylindrical compartment 11 along left side, three slots 15 at right side, a half top opening 12 at a top mouth of the compartment 11, a half bottom opening 13 at a bottom mouth of the compartment 11, and a stop groove 110 adjacent the right side of the compartment 11. Interior features of the rear shell 10A substantially mirror that of the front shell 10B except for the window 14 in the front shell 10B, and that the projecting stop groove 110 of the rear shell 10A is received in a recess (not shown) of the front shell 10B. Thus, complete housing 10 is assembled by the shells 10A and 10B.

The lock further comprises a dial assembly 30 including three wheel-like dials 31 each having, for example, ten indicia formed on its outer surface, and a plurality of teeth formed on its inner surface, and three tumbler sleeves 32 having teeth on its outer surface adapted to lockingly engage with the teeth of the dials 31. The dial assembly 30 is mounted in the right side of the housing 10 with the dials 31 projected out of the slots 15.

The lock further comprises a leaf spring 80 mounted to the left of the dial assembly 30. The leaf spring 80 has three arms 81 pressed against the peripheries of the dials 31 to assist in retaining the dials 31 in their current positions.

The lock further comprises a cylinder 40 mounted in a lower portion of the compartment 11 and comprises a side protuberance 44 rested upon a flat of the rear shell 10A, a bottom keyhole 41 proximate and aligned with the bottom opening 13, a top enlargement 42, and a rectangular projection 43 projecting from the enlargement 42.

The lock further comprises a cylindrical rotatable member 50 including a bottom hole 52 conformed to receive the projection 43 and retain same therein, and an upper spiral groove 51.

The lock further comprises a sleeve member 60 mounted in an upper portion of the compartment 11 and having an upper portion projecting out of the top opening 12. The sleeve member 60 comprises two opposite bottom projecting fins 64 of which one fin 64 is moveably retained in the spiral groove 51, a flat cut 61 in a middle portion thereof, an axial channel 63, a lower elongated trough 65 for dividing the cut 61 into two spaced portions, a plurality of furrows 66 on a lower portion of the trough 65, and a hollow upper protrusion 62 projected out of the top opening 12 and having a flared top opening 620 and a bottom opening 621 in communication with the channel 63.

The lock further comprises a moveable indicator 70 mounted on the cut 61 and comprising a lengthwise rod 71, fitted in both the channel 63 and the bottom hole 52, spaced from the projection 43 by a small distance when in a locked position. The rod 71 having a top member 710 aligned with the bottom opening 621, an indication surface 72 adapted to move between two end walls of the cut 61 and including a first state surface 72A (e.g., preferably the color "green") aligned with the window 14 in a normal position, and a second state surface 72B (e.g., preferably the color "red"), a limiting member 73 engaged with the trough 65, and a resilient latch 74 adapted to secure to one of the furrows 66 for assisting the positioning of the indicator 70.

The lock further comprises a U-shaped shackle 20 including a long leg 21 having a plurality of projecting locking fins 210 slidably retained in the dial assembly 30 as the long leg 21 inserted into the sleeves 32 with its bottom end engaged with a bottom of the housing 10, and a short leg 22 having a bottom end engaged with flared upper top opening 620 when a lower portion of the short leg 22 is inserted into the protrusion 62 (i.e., the lock is locked). The shackle 20 is adapted to rotate about an axis of the long leg 21 relative to the housing 10.

Figure 7:
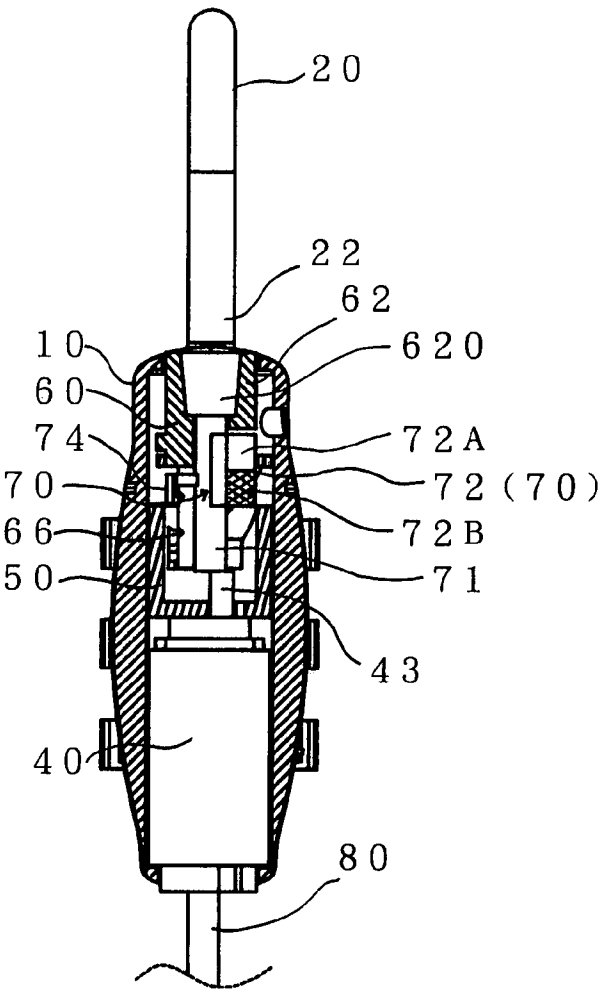
FIG. 7 is a longitudinal sectional view of FIG. 6.
Figure 6:
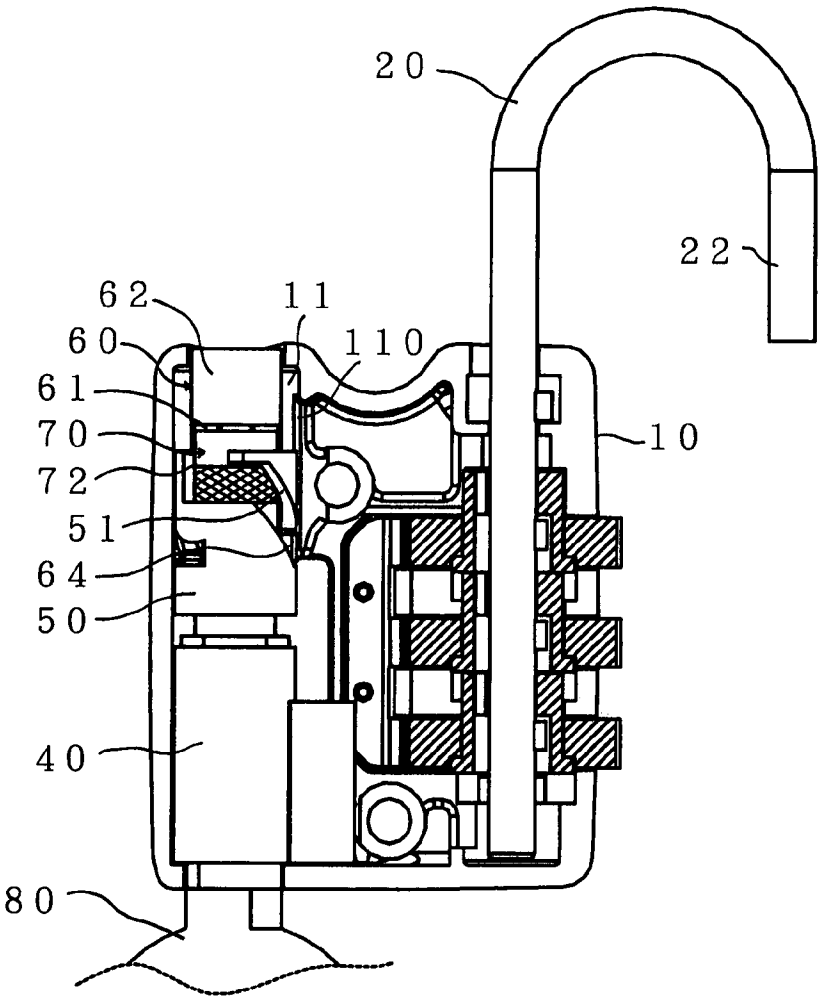
FIG. 6 is a view similar to FIG. 3 with the shackle unlocked and turned a half turn relative to the housing by inserting a key into the housing and turning the inserted key.
Figure 9:
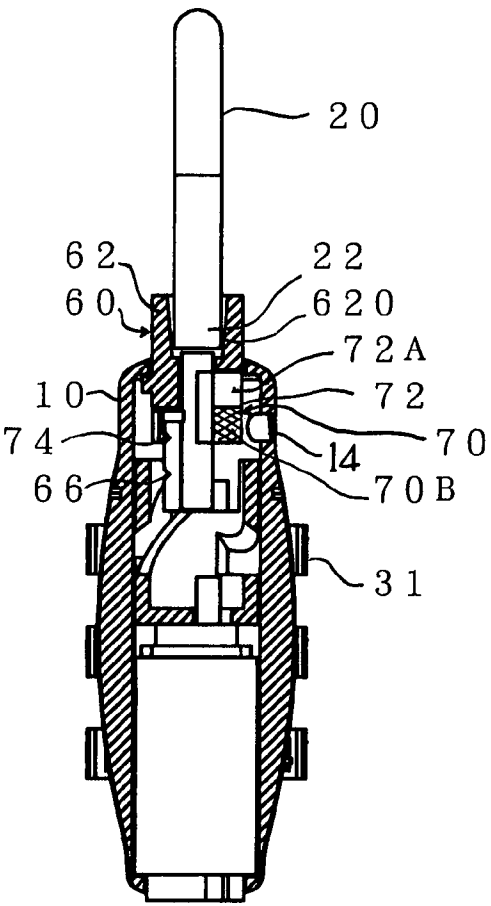
FIG. 9 is a longitudinal sectional view of FIG. 8.
Figure 8:
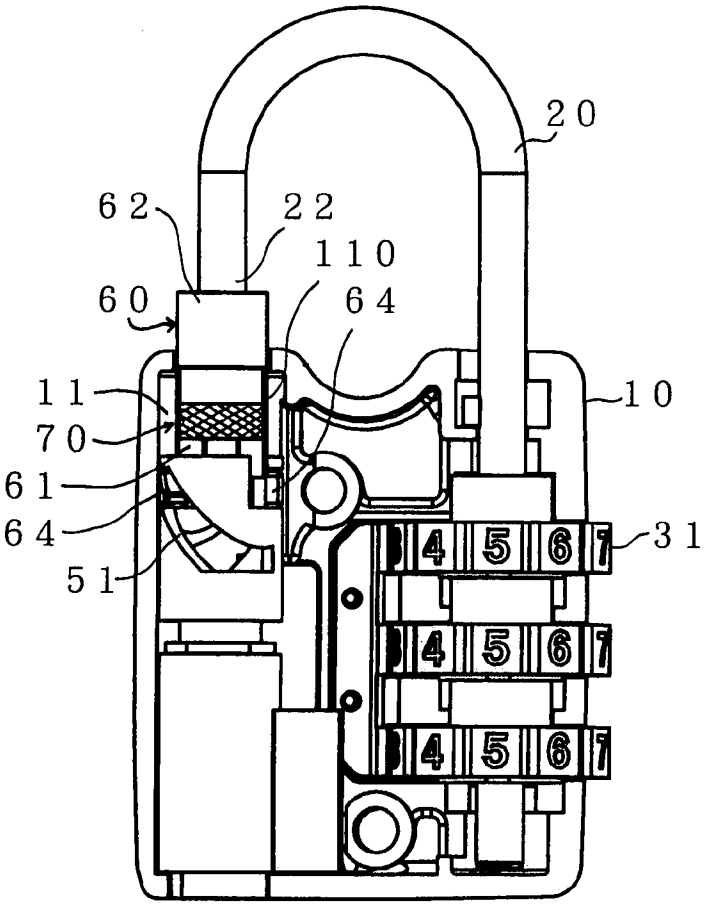
FIG. 8 is a front view of the lock of FIG. 1 with the front shell of the housing removed and the shackle locked again after having been opened by a key.

An operation of opening the lock by a key 80 is illustrated below (see FIGS. 6 and 7). A person can insert the key 80 into the keyhole 41 to turn the cylinder 40, and thus the rotatable member 50, in a direction consistent with the advance of the spiral groove 51 (either clockwise or counterclockwise). Next, the sleeve member 60 moves downward as a result of the fins 64 movement along the spiral groove 51. In other words, the short leg 22 (i.e., the shackle 20) moves upward relative to the sleeve member 60. That is, the lock is unlocked. Note that the fixed stop groove 110 is engaged with the fins 64 so as to prevent the sleeve member 60 from turning (i.e., the sleeve member 60 defined to move axially back and forth in the compartment 11 only).

Further, as the sleeve member 60 moves downward, the rod 71 of the indicator is restrained by the top projection of the cylinder causing the indicator 70 to move upward relative to the cut 61 so as to move the indication surface 72 from a lower portion of the cut 61 to its upper portion until being stopped. As a result, the second state surface 72B (e.g., the color "red") is aligned with the window 14 when the shackle is relocked. Any person can understand that the lock has been opened by a key by viewing the second state surface 72B through the window 14.

Figure 5:
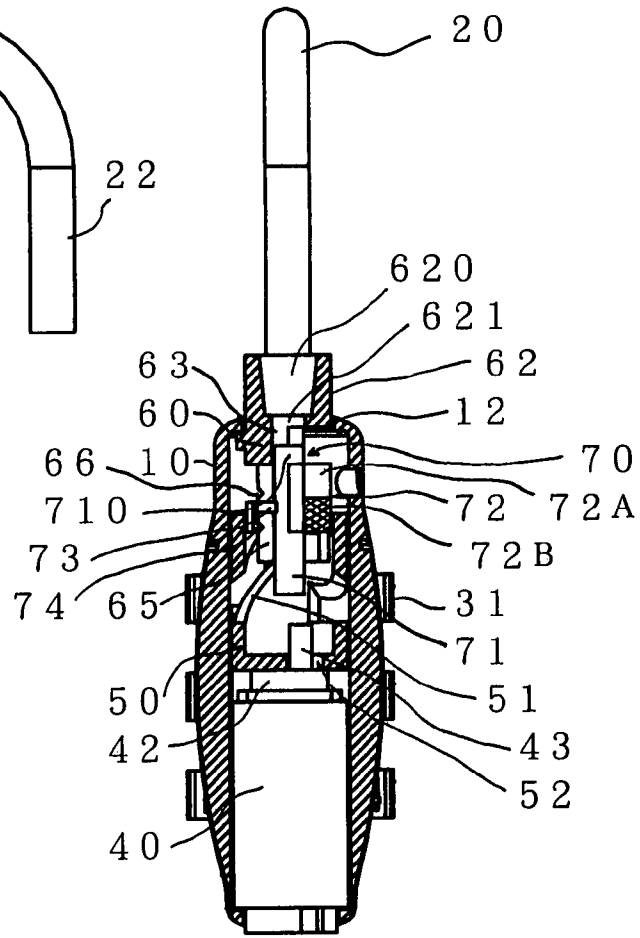
FIG. 5 is a longitudinal sectional view of FIG. 4.
Figure 4:
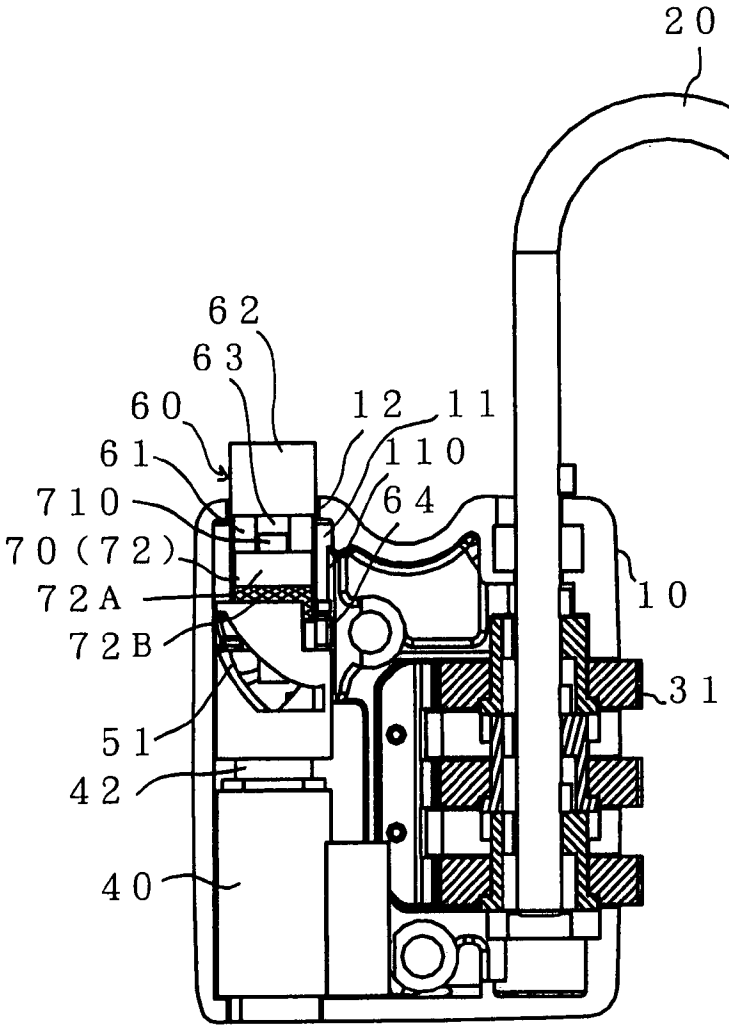
FIG. 4 is a view similar to FIG. 3 with the shackle unlocked and turned a half turn relative to the housing by entering a correct combination.

Opening the lock by a correct combination will now be described in detail below (see FIGS. 4 and 5). First, turn the dials 31 until a correct combination is obtained. That is, the long leg 21 is unlocked in the dial assembly 30 (i.e., the lock is unlocked). Next, pull the shackle 20 upward to unlock the short leg 22 by moving the short leg 22 upward relative to the sleeve member 60. Next, pivot the shackle 20 about half turn relative to the housing 10 to clear the top opening 620 of the protrusion 62. Next, use a pointed object to press the top member 710 through the top opening 620 of the protrusion 62 to return the indicator 70 to its original position. As a result, the first state surface 72A (e.g., the color "green") is aligned with the window 14. That is, the indicator 70 is reset to display the first state surface 72A (e.g., the color "green") through the window 14.

While the invention herein disclosed has been described by means of specific embodiments, numerous modifications and variations could be made thereto by those skilled in the art without departing from the scope and spirit of the invention set forth in the claims.

What is claimed is:

1. A combination and key operated padlock comprising:

a housing comprising a front shell portion and a rear shell portion with a window formed through the front shell portion, a plurality of slots formed on right side, an interior cylindrical compartment on a left side having bottom and top openings, and an interior fixed stop groove formed adjacent the compartment;

a dial assembly including a plurality of wheel-like dials projecting out of the slots, each dial having a plurality of indicia formed on its outer surface and a plurality of first teeth formed on its inner surface, and a plurality of tumbler sleeves each having a plurality of second teeth on its outer surface adapted to lockingly engage with the first teeth;

a leaf spring having a plurality of arms pressed against the peripheries of the dials to assist in retaining the dials in their current positions;

a cylinder mounted in a lower portion of the compartment and including a bottom keyhole proximate and aligned with the bottom opening of the compartment, a top projection, and a protuberance on a right side;

a cylindrical rotatable member including a bottom hole conformed to securely receive the projection of the cylinder, and an upper spiral groove;

a sleeve member mounted in an upper portion of the compartment and including two opposite bottom projecting fins, one fin moveably retained in the spiral groove and the other fin moveably retained in the stop groove, a flat cut in a middle portion thereof, an axial channel, a lower elongated trough for dividing the cut into two spaced portions, a plurality of furrows on a lower portion of the trough, and a hollow upper protrusion in communication with the channel and projected out of the top opening of the compartment;

an indicator, mounted on the cut of the sleeve member, including a lengthwise rod fitted in both the channel and the bottom hole to be engageable with the projection of the cylinder, and having a top member aligned with a bottom of the upper protrusion of the sleeve member, an indication surface adapted to move between two end walls of the cut and including a first state surface having a first color aligned with the window in a locked position of the lock for indicating that the lock is in a normal state and a second state surface having a second color different from the first color for indicating that the lock has been opened by a key, a limiting member engaged with the trough, and a resilient latch adapted to secure to one of the furrows for assisting a positioning of the indicator; and a substantially U-shaped shackle including a long leg in the sleeves and having a plurality of projecting locking fins slidably retained in the dial assembly, and a short leg having a bottom end engaged with a flared top opening of the upper protrusion of the sleeve member in the locked position of the lock, the shackle adapted to rotate about an axis of the long leg relative to the housing when the lock is unlocked;

wherein the shackle may be unlocked by inserting a key into the keyhole to turn the cylinder together with the rotatable member moving the sleeve member downward urged by the fin engaged with the spiral groove, disengaging the short leg from the upper protrusion, however as the sleeve moves downward a bottom end of the rod of the indicator is restrained by the projection of the cylinder urging the indicator to move upward relative to the sleeve member, causing the indication surface to be moved from a lower portion of the cut to its upper portion thereby aligning the second state surface with the window for visually informing that the lock has been opened by a key; and further wherein, the lock may be unlocked by combination to disengage the shackle from the upper protrusion without effecting the indicator, and while in an open position allowing the indicator to be reset to an original position.

* * * * *